US005177931A

United States Patent [19]

Latter

[11] Patent Number: 5,177,931

[45] Date of Patent: Jan. 12, 1993

[54] MODIFIED SEALING MACHINE

[76] Inventor: Melvin R. Latter, c/o M. Latter Mfg., Inc., 3669 - 7th Ave., Los Angeles, Calif. 90018

[21] Appl. No.: 439,272

[22] Filed: Nov. 20, 1989

[51] Int. Cl.[5] ..... B65B 51/10; B65B 9/06; B65B 53/02

[52] U.S. Cl. ..... 53/133.3; 53/133.8; 53/557; 53/568; 53/374.8; 493/929

[58] Field of Search ..... 53/128, 133, 373, 410, 53/412, 433, 442, 455, 459, 463, 477, 479, 511, 557, 562, 568, 128.1, 133.1, 133.5, 133.7, 133.8, 374.8, 374.9; 156/515, 583.4, 583.8, 583.9; 493/194, 195, 206, 929

[56] References Cited

U.S. PATENT DOCUMENTS

| | | | |
|---|---|---|---|
| 3,016,284 | 1/1962 | Trexler | 53/479 X |
| 3,123,955 | 3/1964 | Weissensee et al. | 53/442 |
| 3,390,507 | 7/1968 | Repko | 53/412 |
| 3,496,700 | 2/1970 | McCabe et al. | 53/568 X |
| 3,516,537 | 6/1970 | Dreyfus et al. | 53/412 X |
| 3,681,890 | 8/1972 | Pringle et al. | 53/575 X |
| 3,912,575 | 10/1975 | Zelnick | 53/568 X |
| 4,000,029 | 12/1976 | Michaels | 156/583.4 |
| 4,175,994 | 11/1979 | Norton et al. | 53/477 X |
| 4,256,024 | 3/1981 | Carlisle | 493/194 X |
| 4,512,138 | 4/1985 | Greenawalt | 53/552 X |
| 4,697,401 | 10/1987 | Kessler et al. | 53/459 |
| 4,905,452 | 3/1990 | Vogan | 53/412 |

FOREIGN PATENT DOCUMENTS

| | | | |
|---|---|---|---|
| 974827 | 11/1964 | United Kingdom | 156/515 |

*Primary Examiner*—John Sipos
*Assistant Examiner*—Linda B. Johnson
*Attorney, Agent, or Firm*—Ladas & Parry

[57] ABSTRACT

Disclosed herein is a modified L-sealer machine for use in wrapping products in plastic wrap. The machine cuts the wrap to form integrally therein a tear tab. This is done by modifying the L-sealer bar to shape the tab in the plastic wrap while sealing it around the product.

11 Claims, 6 Drawing Sheets

FIG. 7a
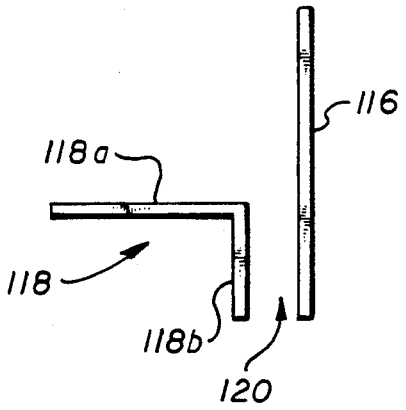
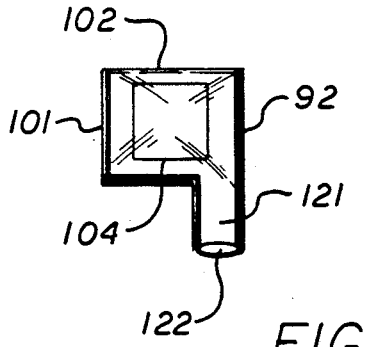
FIG. 7c
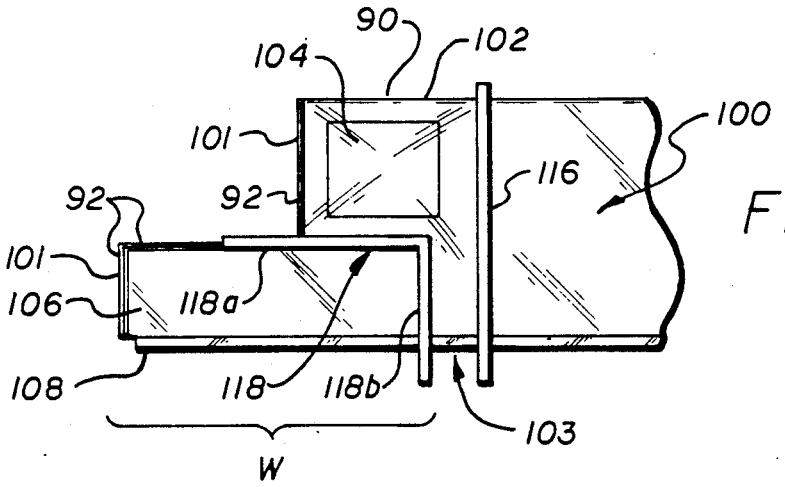
FIG. 7b
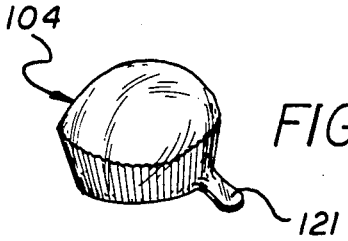
FIG. 7d
FIG. 8a
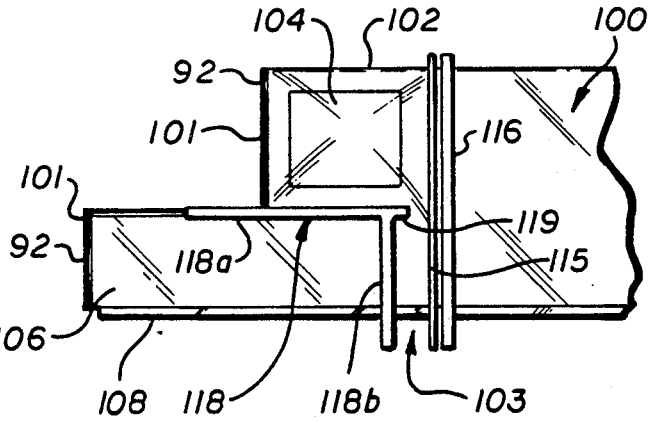
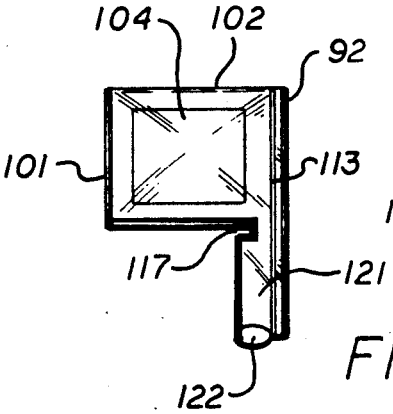
FIG. 8b FIG. 9a
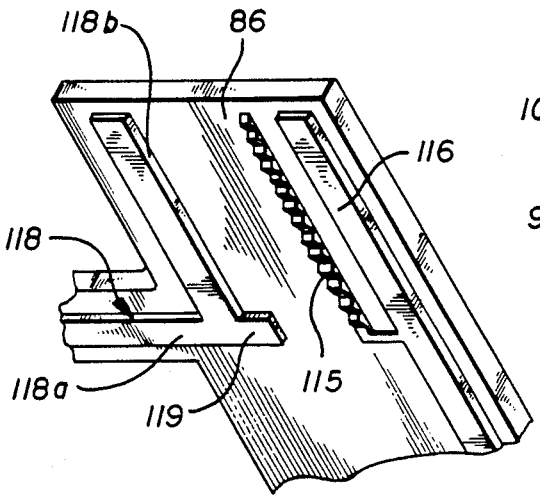
FIG. 9b
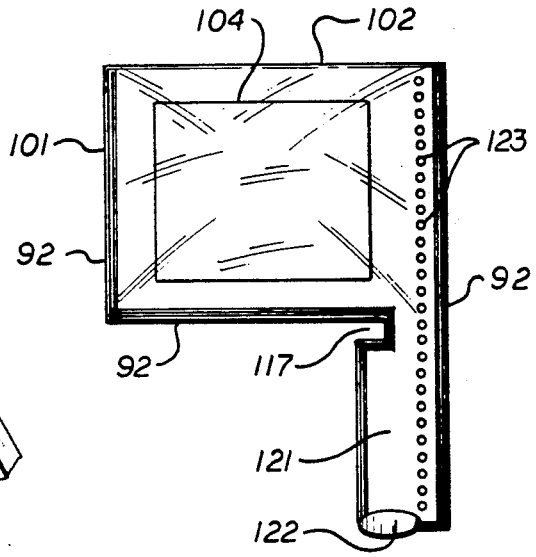
FIG. 10a
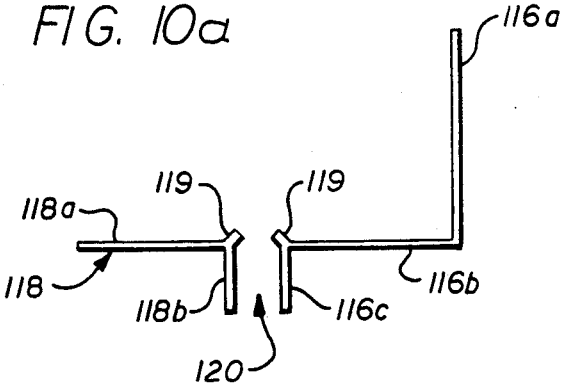
FIG. 10b
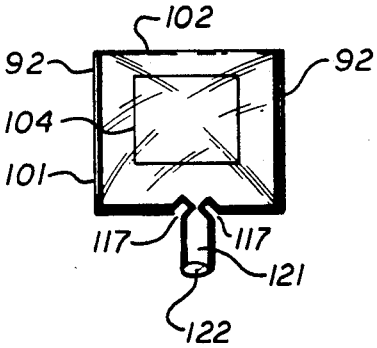
FIG. 13
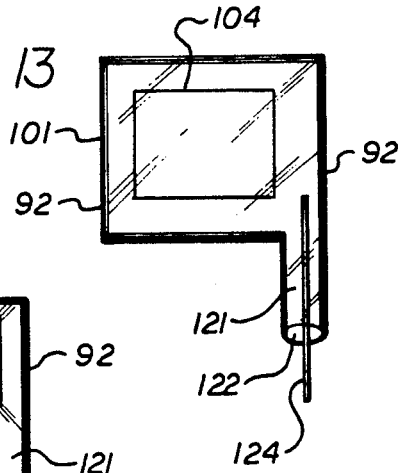
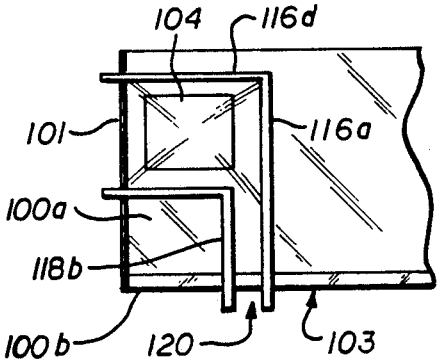
FIG. 11
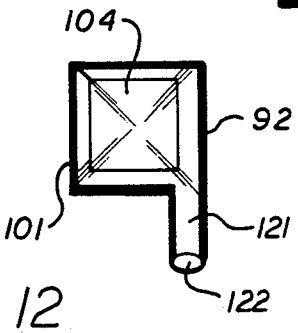
FIG. 12

FIG. 14
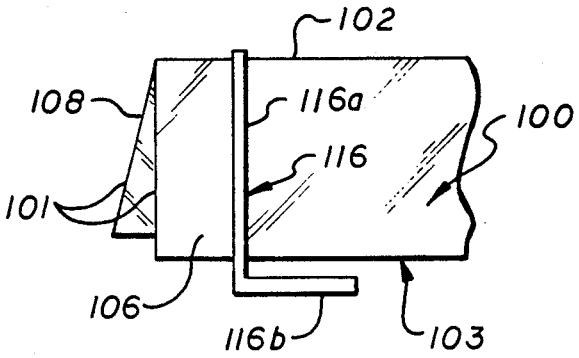
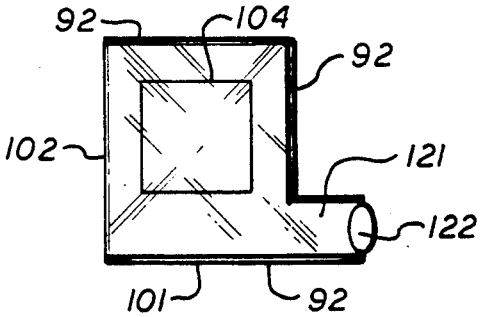
FIG. 17
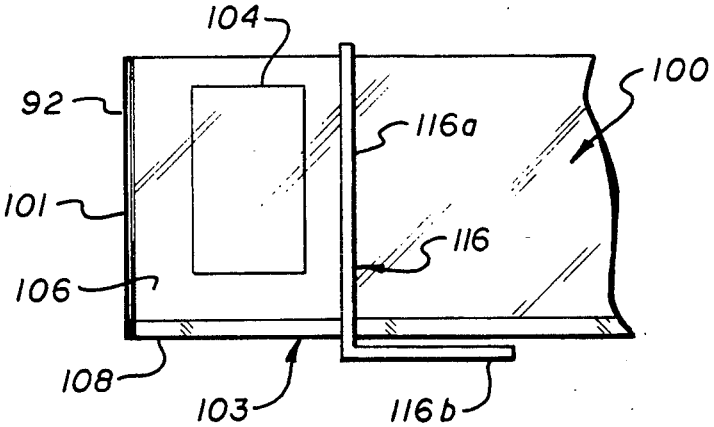
FIG. 15
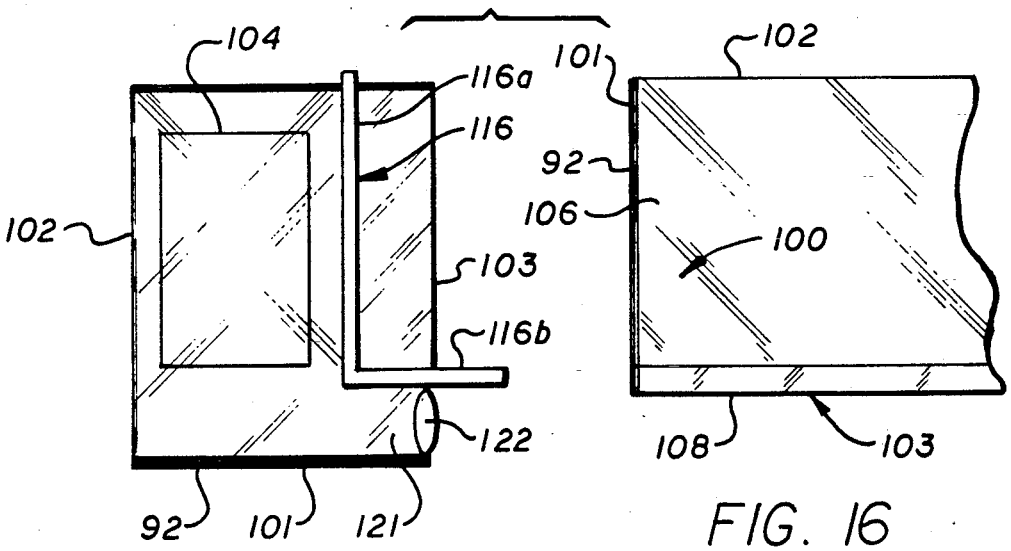
FIG. 16

MODIFIED SEALING MACHINE

BACKGROUND OF THE INVENTION

The present invention relates to sealing machines for shrink wrapping and other type of packaging.

As known in the art, hand-fed and automated wrapping of items, and in particular, shrink wrapping, involves the following process. A center-folded plastic sheet wrap is pulled from its roll over a separator bar or plate to separate the wrap about the fold thereby providing a space for insertion of the product to be sealed by the wrap. The leading edge of the wrap, if not sealed together, is then sealed. If it is intended to ultimately shrink the wrap around the product with hot air, holes are made in the wrap usually by the application of hot or cold punches prior to or after pulling the wrap to the area in which the product to be packaged is inserted. The product is then inserted into the wrap, that is, between both sides of the wrap defined by the fold, and the product and wrap are then pulled to a sealing area. Here a sealer frame shaped like a reverse L is pulled down onto the wrap around the product. The sealer frame is designed to carry heat so that when it is lowered and pressed onto the wrap around the product, it seals both sides of the wrap together in the area where the sealer bar is present, thereby sealing the product in the space within the wrap. When the sealer frame touches the wrap, it softens and bonds or laminates together the two sides of the wrap both under and near the frame. If the frame is left on the wrap for an adequate period of time, the heated plastic wrap under the frame melts away from the remaining wrap so that when the reverse-L sealer frame is lifted, the product and its surrounding wrap stand independent of the remainder of the wrap and may be readily moved to the hot air shrinking area. The edge of the remaining portion of the wrap is sealed from the heat generated from the sides of the reverse-L sealer frame. Thus, when the reverse-L sealer frame is again brought down for the next product, the next product is fully sealed on all sides.

In the shrink-wrapping process, the sealed product is transferred to an area in which hot air is applied to shrink the wrap tightly around the product. The holes in the wrap formed earlier by the hot or cold punches allow the air trapped between the wrap and the product to escape so that the wrap shrinks to the size of the product contained within its bounds without an air pocket being formed therebetween. During such shrinking process, the hot or cold formed holes do not seal closed.

One disadvantage of the foregoing wrapping method is that it provides no means for removal of the product once the wrapped product has reached its ultimate consumer. The user is left to use outside cutting means to sever the wrap to release the product. At times, this can result in the user inadvertently damaging the product in the process of cutting away the wrap.

A second disadvantage is the requirement of the additional step of "venting" the wrap by punching holes therein should shrink wrapping be desired.

A third disadvantage is that the product is sealed on all four sides when it may be desired that one side be left open.

Known sealing devices are disclosed in U.S. Pat. No. 4,697,401 to Kessler, U.S. Pat. No. 3,123,955 to Weissensee, U.S. Pat. No. 4,512,138 to Greenawalt, and U.S. Pat. No. 3,681,890 to Pringle.

U.S. Pat. No. 3,681,890 to Pringle addresses the first disadvantage noted herein by disclosing a machine in which a tear tab is heat-sealed to the seam of each wrap for tearing open the wrap to get to the enclosed product. However, the tear tab disclosed by Pringle requires the addition of an extra step to the sealing process, that of attaching a tear tab. Further, the tear tab is not fail proof. If it is not properly sealed to the wrap, it may rip free of the wrap without creating an opening in the wrap to reach the inside product This is particularly likely with the Pringle method since the tear tab is attached to a seam area, one of the stronger areas of the wrap and thus one of the areas least likely to rip.

Kessler in U.S. Pat. No. 3,123,955 and Weissensee in U.S. Pat. No. 3,123,955 address the issue of maintaining one open edge of the product but do so by adding the step of cutting that edge open after the product has been sealed within the plastic wrap.

The present invention discloses a tear tab that is integral with the sealing wrap rather than merely attached to the wrap. Therefore, it is a tab that will not rip away from the wrap without ripping the wrap too. It does this without adding an additional step to the packaging process.

The invention also discloses a method of providing venting while eliminating the step of using hot and cold punches.

Finally, it discloses a means of packaging a product in a wrap while leaving one side of the wrap unsealed and therefore open to enable removal of the product. It does this without adding a cutting or other additional step to the known packaging process.

SUMMARY OF THE INVENTION

Disclosed herein is a method of sealing a product within two sides of plastic wrap comprising the steps of pulling a two sided wrap from a roll so that on one side of the wrap an open base is defined by the two sides;

placing a product into said wrap by inserting it between said two sides;

bringing a heat sealer bar against the wrap and around at least a portion of said product, said bar sealing the wrap around said product except at a tabbed area, said tabbed area defined by said bar and extending away from said product to said open base such that said tab is open.

BRIEF DESCRIPTION OF THE DRAWINGS

The drawings below merely illustrate the invention. They are not necessarily drawn to scale.

FIGS. 7*a*, 7*b*, and 7*c* are diagrammatic views of the sealer frame of the present invention.

FIG. 7*d* is a product that has been sealed and the surrounding wrap hot-air shrunk.

FIGS. 8*a*, and 8*b* are diagrammatic views of the sealer frame of FIG. 7 as modified to include the use of another sealer bar which carries less heat than the bars of the main sealer frame and the use of a cutting extension.

FIG. 9*a* is a modification of the additional sealer bar of FIG. 8*a*.

FIG. 9*b* shows the wrapped package resulting from the use of the frame disclosed in FIG. 9*a*.

FIGS. 10*a* and 10*b* are diagrammatic views of a further embodiment of the present invention and a product wrapped with this embodiment.

FIGS. 11 and 12 show diagrammatically another embodiment of the present invention making use of a flat film wrapping mechanism.

FIG. 13 shows diagrammatically another embodiment of the present invention.

FIGS. 14 through 17 show diagrammatically a last embodiment of the present invention.

DETAILED DESCRIPTION OF THE DRAWINGS

Figure 1:
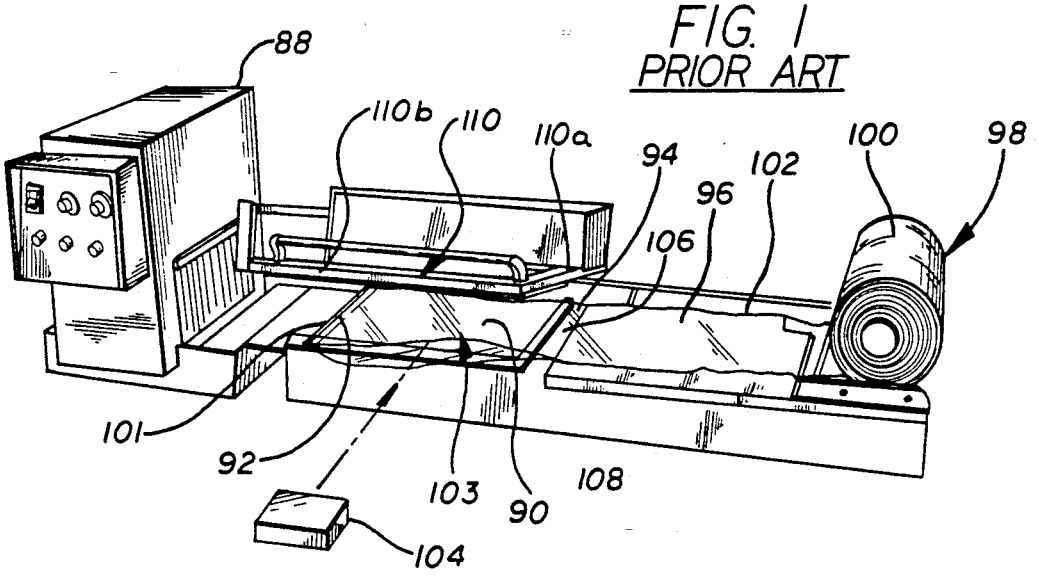
FIG. 1 PRIOR ART
FIG. 1 is a perspective view of a typical prior art reverse-L sealer frame using a center-folded roll of wrap.
Figure 2:
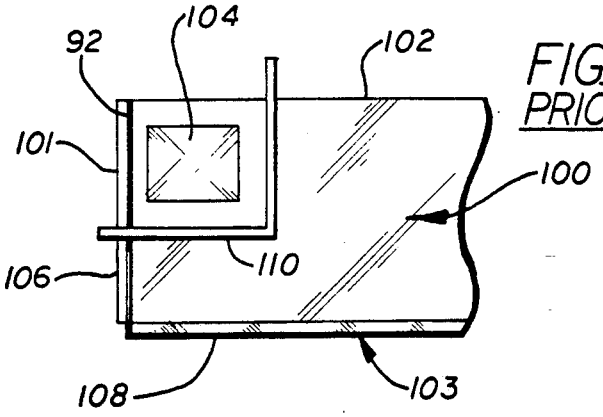
FIG. 2 PRIOR ART
FIGS. 2 through 4, 5*a* and 5*b* are simplified and diagrammatic views of the device of FIG. 1 showing the operating procedure thereof.

Referring now in greater detail to the drawings, the prior art device is disclosed in perspective and diagrammatically in FIGS. 1 through 5. As seen in FIG. 1, conventional plastic film, bag-forming apparatus feed a center-folded shrink plastic wrap or film 100 from a roll 98 over a plate 96 (a bar may be used instead) to separate the wrap or film 100 thereby defining a space in which the product can be inserted. Wrap 100 is comprised of centerfold 102, sides 106 and 108, open base 103 and leading edge 101. Hot or cold punching means (not shown) are used in the area shown as 94 to vent the wrap 100 for later shrink wrapping. If the leading edge 101 of wrap 100 is not already sealed (which it will not generally be if a new roll 98 of wrap 100 is being used), reverse-L sealer frame 110 will be brought down on wrap 100 near leading edge 101 before inserting the first item to be packaged. Frame 110 is comprised of bars 110*a* and 110*b*, which are connected at right angles to each other in the shape of a reverse L. Bar 110*a* lies parallel to leading edge 101 of the film and is used to initially seal that edge. As noted above, the reverse-L sealer frame 110 is heated so that when bar 110*a* is brought against the plastic wrap 100 near edge 101, it will melt and sever the wrap directly under the bar and seal or laminate the wrap 100 around the edges of the bar. Therefore, by bringing frame 110 and the bar 110*a* against wrap 100 near edge 101, bar 110*a* will form a new edge 101 under the area where bar 110*a* of frame 110 was placed and a sealed portion 92 next to that edge 101. The frame 110 is then lifted, and the product 104 to be packaged is inserted in wrap 100 near sealed 92 edge 101. Product and surrounding wrap are then pulled fully into the sealing station 90 and reverse-L sealer frame 110 is brought down around the product to fully seal it within wrap 100 as described below.

When frame 110 is lifted, the product and its surrounding wrap stand free of the remaining wrap 100 since the frame has acted to sever the wrap as well as seal it in the areas of severance. Package and wrap may then be moved into the hot air shrinking area 88 to shrink the wrap which surrounds product 104 around product 104. Instead of a hot-air shrinking area per se being used, the product and wrap may be manually removed and a heat gun, which blows hot air, may be used to shrink the film 100 about the product 104.

The foregoing process is illustrated diagrammatically in FIGS. 2 through 5. The center fold 102 of the wrap 100 divides wrap 100 into two sides 106 and 108 thereby creating a two-layered base having an open end 103 which lies opposite the center fold 102. The leading edge 101 of the wrap 100 is sealed ab initio at 92 as discussed above and thereafter, each succeeding leading edge 101 is sealed from the sealing of a preceding product. Also as noted above, wrap 100 may be pierced to provide vent openings prior to inserting the product 104 between sides 106 and 108.

Product 104 is inserted through open base 103, into wrap 100, between sides 106 and 108, near presealed 92 leading edge 101 and center fold 102. The frame 110 is then brought down against wrap 100 and around product 104 to seal product 104 within wrap 100. Since the frame 110 is heated, upon contacting the wrap 100, it pushes sides 106 and 108 against one another and melts or laminates them together and away from the main body of wrap 100. Thus product 104 is fully sealed into wrap 100 by presealed leading edge 101, center fold 102, and the newly sealed 92 edges defining the shape of frame 110. Upon removal of frame 110, product and wrap stand independent of the main wrap 100 due to the melting and severing of wrap 100 directly under bars 110*a* and 110*b* as discussed above.

Figure 3:
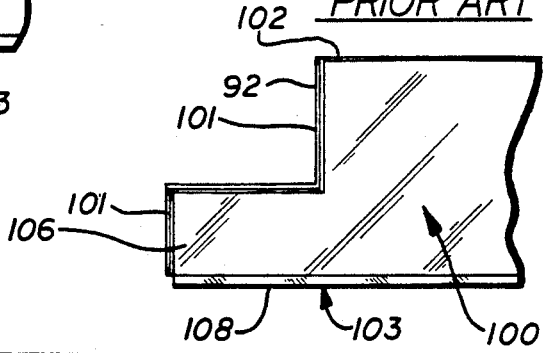
FIG. 3 PRIOR ART
Figure 4:
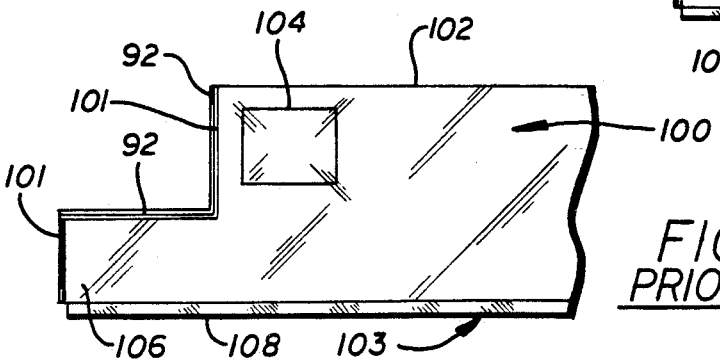
FIG. 4 PRIOR ART
Figure 5A:
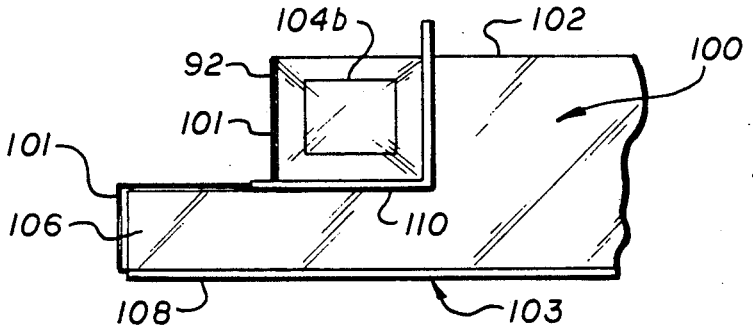
FIG. 5a PRIOR ART
Figure 5B:
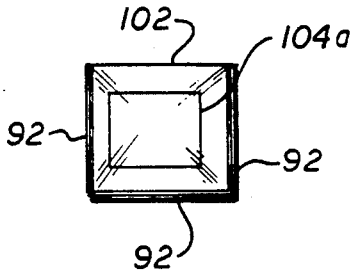
FIG. 5b PRIOR ART

As noted above, the melting or laminating process caused by frame 110 on wrap 100 occurs to some degree around the periphery of frame 110 as well as directly thereunder. Thus when product 104 and its surrounding wrap 100 are free of the main portion of wrap 100 as shown in FIG. 3, there is left a newly sealed 92 leading edge 101. As shown in FIG. 4, the foregoing process is repeated, a new product 104 being inserted between sides 106 and 108 through base 103 near newly sealed 92 leading edge 101. FIGS. 5*a* and 5*b*, depict the entire process showing one product 104*a* in its sealed state and a second product 104*b* being sealed into wrap 100.

After product 104 and its surrounding sealed wrap 100 are removed from the sealing area as shown in FIG. 5*b*, they are then passed to the hot air shrinking area 88 shown in FIG. 1, if shrinking of the wrap tightly around the product 104 is desired. In the shrinking area, both product and wrap are subjected to a bath of hot air causing wrap 100 to "shrink" to a close fit around product 104, air trapped between product 104 and wrap 100 being expelled through the vent openings earlier discussed.

The product and its form-fit wrap are then ready for labelling or shipment. Of course, as noted above, the ultimate consumer must then remove the wrap from the product to access the product. Since no means of removal has been provided, the consumer is left to struggle with the opening of the wrap which struggle may result in the damage of product 104.

For the convenience of the ultimate consumer, the present invention discloses a means of creating a wrap with an integral tear tab. This tear tab also acts as a venting means so that puncturing of the outside wrap by hot or cold punches is unnecessary.

Figure 6:
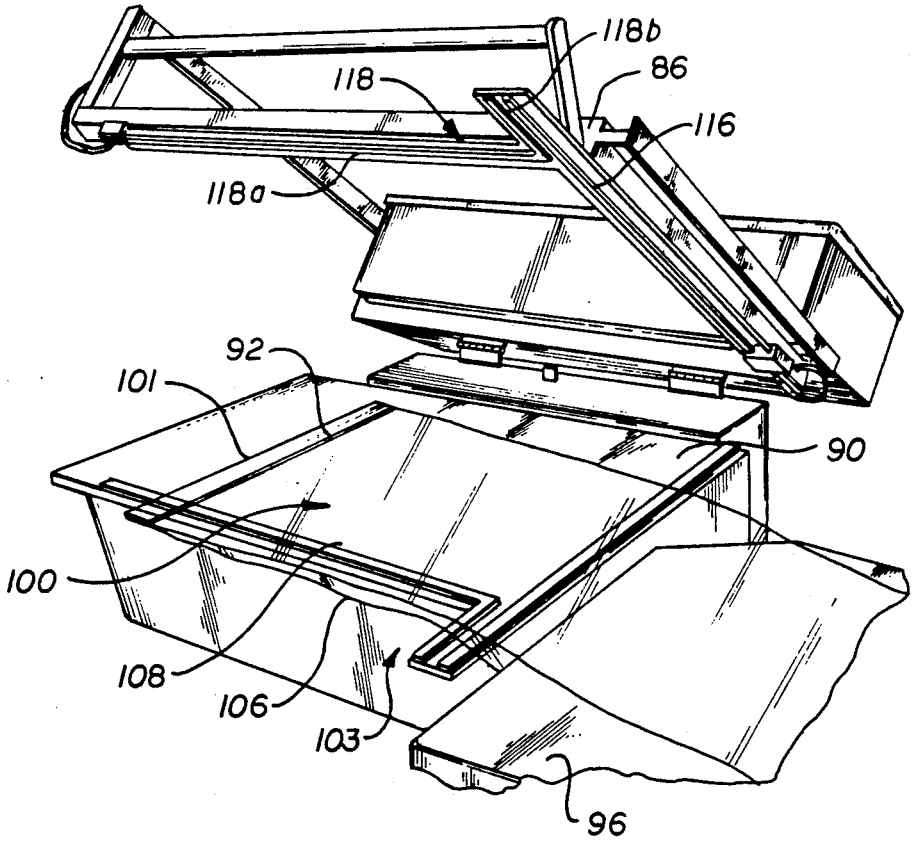
FIG. 6 is a perspective view of a first embodiment of the sealer frame of the invention.

In FIG. 6, a first embodiment of the present invention, a modified sealing frame, is disclosed. The frame portion which will make contact with wrap 100 is no longer a reverse L-shaped frame but a frame comprised of two separated bars. Even though these bars may ultimately be joined for ease of wiring by being mounted on a common base 86 as shown in FIG. 6, as shown in the diagrammatic views of FIG. 7*a* and 7*b*, the bars which will touch wrap 100 will be seen on a planar level to be separated.

The first piece of the frame, bar 116, is merely a straight bar which lies transverse to the direction of advancement of the wrap 100 and product 104. The second bar 118 is generally L-shaped so that one portion 118*a* lies transverse to bar 116 and another portion 118*b* lies parallel to bar 116. Thus, defined between portion 118*b* and bar 116 is a generally rectangular space 120 which will produce an integral rip tab in the wrap 100, as described below.

Wrap 100 does not need to be prepunched with vent openings. Instead, wrap 100 is pulled from roll 98, passed over bar or plate 96 to separate sides 106 and 108, and the product 104 is then inserted through open base 103 near leading edge 101 (assuming it to have been presealed) and center fold 102. Wrap and product are fed directly to the sealing station 90 which may be a flat metal base onto which the bars 116, 118 of the present invention may be brought down against the wrap and around the product. Or the base may be shaped like the bars as shown in FIG. 6.

When the frame is brought down against the wrap 100 and around product 104, the frame comprised of bars 116 and 118, bonds sides 106 and 108 together around the periphery of product 104 by means of heat and pressure. However, as illustrated in FIGS. 7*b* and 7*c*, (which drawings are not to scale, the rip tab being exaggerated in size), the entire periphery is not bonded. Instead integral rip tab 121 is formed by the spaced relationship of portion 118*b* and bar 116. The portion 118*b* and bar 116 extend at least to and preferably beyond open base 103. In this way, rip tab 121 is left open at open base 103 to be used later as a vent opening 122 should shrink wrapping be desired.

FIG. 7*c* shows a product wrapped with the present frame comprised of bars 116, 118 after bars 116, 118 have been lifted away. The section of wrap which is defined in part by portions 118*a* and 118*b* and designated generally with a "w" in FIG. 7*b* becomes waste and is discarded leaving a newly sealed edge 101 as described above. The product 104 sealed in its wrap 100 is severed by the heat from bars 116, 118 as described above, from the remaining portion of wrap 100 and is ready to be passed to the hot air shrinking station 88 where it is exposed to hot air to shrink the wrap around the product 104. Air caught between wrap 100 and product 104 is expelled through opening 122.

Integral rip tab 121 is also shrunk although it will remain as an extension from the product and wrap. In FIG. 7*d*, a perspective view of the wrap and product of FIG. 7*c* is shown after shrink wrapping, tab 121 clearly extending outwardly of the wrap 100 which tightly surrounds product 104.

After the hot air shrinking step, the wrapped product is then ready for the consumer who will be able to readily access the product by pulling integral rip tab 121 to rip away wrap 100 from product 104. And, since integral rip tab 121 is integral to wrap 100, it will not rip away from wrap 100 without opening wrap 100 for removal of product 104.

FIGS. 8*a* and 8*b*, are a modification of FIGS. 7*b* and 7*c*. The frame before comprised of bars 116, 118 now consists of a third bar 115 which lies parallel to bar 116 and between bars 118 and 116 although it is placed much closer to bar 116 than 118. While bar 115 is shown narrower than bars 116 and 118, it could be as wide or wider than these bars. Bar 115 is, however, designed to carry less heat than bars 116 and 118. As in the preceding embodiment, while the wrap 100 will experience contact with three separated bars, these bars may be ultimately joined in the fashion shown in FIG. 6 to facilitate the wiring and manufacture of these bars. The purpose of bar 115 is to create a second seam in the wrap that surrounds product 104. Because bar 115 carries less heat than bars 116 and 118, bar 115 will not cause the portion of wrap 100 which it touches to be severed from the surrounding wrap 100 when bar 115 is placed against the plastic wrap 100 for the same length of time as bars 116 and 118. Only bars 116 and 118 will do this. Bar 115 will only bind or laminate sides 106 and 108 together to form a seam 113. Thus when the frame comprised of bars 115, 116, 118 is lifted away from wrap 100, seam 113 will be present as seen in FIG. 8*b*. This seam 113 will enhance rip tab 121 so that it is stronger and more likely to rip wrapping 100 along at least a portion of the length of seam 113, to ensure the creation of a larger opening in wrap 100 when pulling rip tab 122.

Also shown in FIG. 8*a* (not necessarily drawn to scale) is a modification of portion 118*a*. Here portion 118*a* extends beyond portion 118*b* toward bar 116 to form an extension 119. Extension 119 will cause wrap 100 to melt thereunder creating slit 117 as shown in FIG. 8*b* (not necessarily drawn to scale). The presence of this slit will again facilitate the functioning of rip tab 121. Although extension 119 is shown in combination with bar 115, the two need not be used in combination. Either one may be present alone. Further, extension 119 could just as well extend from portion 118*b* toward product 104 or extend diagonally from the corner joinder of portions 118*a* and 118*b*. That is, extension 119 would bisect the corner formed by portions 118*a* and 118*b* and extend toward bar 116. It could also extend in an angle from bar 116. Finally, bar 115 could be located more centrally of bar 116 and 118*b*.

FIG. 9*a* is a perspective view showing a modification of bar 115. Here bar 115*a* is serrated on its surface which will contact wrap 100 when bars 115, 116, and 118 are brought against wrap 100. Here, also, bar 115 carries the same amount of heat as bars 116, and 118. The serrations cause a plurality of spaced holes to be melted into wrap 100 at each point where bar 115 contacts wrap 100. Thus when the frame comprised of bars 115, 116, 118 is lifted from wrap 100 and product 104, rip tab 121 and a portion of wrap 100 will have defined therein a line of openings 121 as shown in FIG. 9*b* (not necessarily drawn to scale). These openings 123 are large enough so that during the heat shrinking process they will not close. The openings 123, create a perforated rip line or weakening for later opening the wrap by pulling rip tab 123 to rip away the wrap along these openings 121 from product 104.

Shown in FIG. 10*a* is a further embodiment of the invention. Bar 118 is the same shape as in the preceding figures. It is comprised of a first portion 118*a* which extends parallel to the direction of feed of wrap 100 and product 104, and a second portion 118*b* which extends transversely to the direction of feed of wrap 100 and product 104. This second portion 118*b* would extend to, at least, the open base 103 of wrap 100. Bar 116 is no longer a straight bar but forms two angles to define portions 116*a*, 116*b* and 116*c*. First portion 116*a* extends transverse to the feeding direction of the shrink wrap 100 and parallel to portion 118*b*. Second portion 116*b* is connected to first portion 116*a* and extends generally parallel to the direction of feed of wrap 100 and product 104. Third portion 116*c* connects to second portion 116*b* and is generally parallel to first portion 116*a*. Third portion 116*c* define with portion 118*b* generally rectangular space 120 so that integral rip tab 121 may be formed in wrap 100. Again preferably, portion 118*b* and third portion 116*c* will extend at least to and/or beyond open base 103 of wrap 100 to leave integral rip tab 121 open at end 122 to vent air between product 104 and its surrounding wrap 100. Angled extensions 119 are also shown at the corners formed by bars 118*a* and 118*b* and bars 116*b* and 116*c*. The extensions and their angular placement are optional. The bars of FIG. 10*a* are used in the same fashion as described for FIGS. 5 and 6. A product 104 wrapped with the aid of the frame comprised of bars 118 and 116 and extension 119 bar of FIG. 10*a* is shown in FIG. 10*b*. The product is again sealed in wrap 100 about its periphery except for integral rip tab 121 with its air vent opening 122 formed from open base or 103.

As can be seen, the present invention permits various modifications of the sealer bars to form integrally with the wrap a rip tab which may act both as a vent and a tab for opening the product. The invention may provide creating more than one rip tab, using extensions on bar 116 as well as on bar 118 to create slits 117 on both sides of rip tab 121, and various other modifications.

Figure 18:
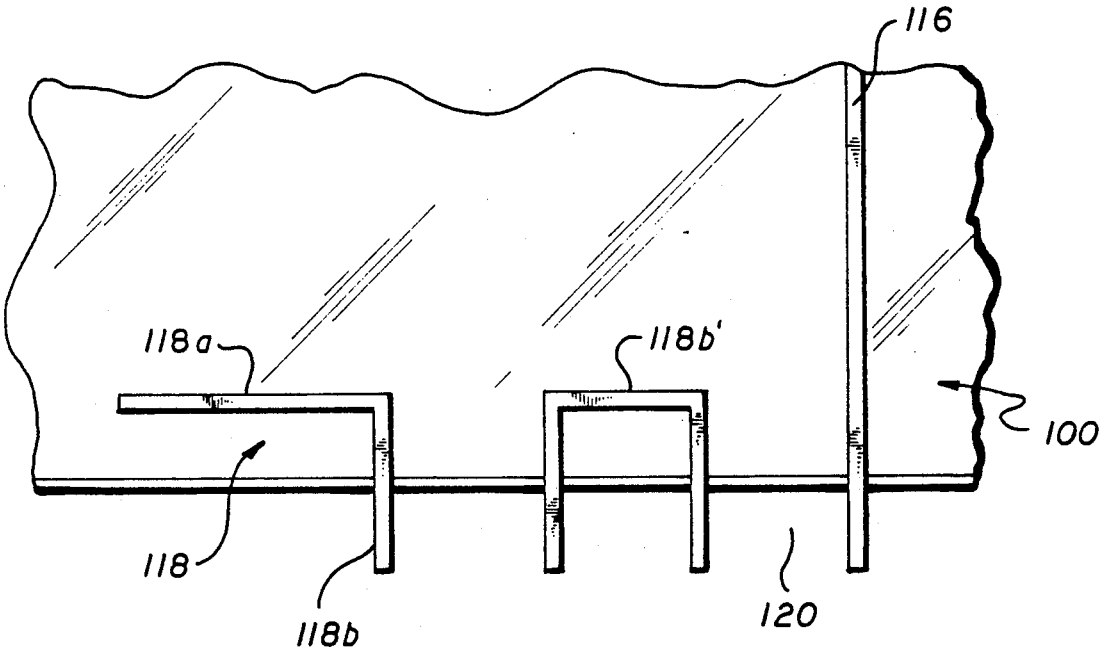
FIG. 18 shows one suggested embodiment of the present invention in which two tabs are formed.

One example of the present invention having two tabs is shown in FIG. 18. In this instance, an additional bar 18*b* may be seen to aid in the making of both tabs.

In FIG. 11, a further modification is shown. This modification accommodates the use of flat or single wound film rather than a center-folded wrap. In this instance, there are two rolls (not shown) of flat or single wound film 100*a*, 100*b*, which are fed into the sealing station 90. Again, there is no need to pierce this film as the present invention obviates the need of venting as a separate step. Product 104 is placed between the two layers of film 100*a*, 100*b*, and the sealing bars 118, 116 are brought down against these two layers of film 100*a*, 100*b*, and around product 104. Because a flat film is being used in this instance, bar 116 has upper portion 116*d* which lies opposite open base 103 and is generally at a right angle to and connected to transverse portion 116*a*. Upper portion 116*d* binds wrap 100 around product 104 in the area where center fold 102 would have been. Transverse portion 116*a* forms with second portion 118*b* again spaced area 120 to form integral rip tab 121 in film 100*a*, 100*b*.

FIG. 12 shows a product wrapped in the two pieces of film 100 with the use of the bars shown in FIG. 11. The product 104 is again sealed about its periphery with the exception of integral rip tab 121 and its vent opening 122 formed by the extension of portions 116*a* and 118*b* to (and perhaps beyond) open base 103.

FIG. 13 discloses an embodiment of the present invention in which the bars and extensions of any of the previous embodiments disclosed in FIGS. 5 through 12 and 14 through 17 are shown. In this embodiment, prior to shrink wrapping film 100 and rip tab 121 around product 104, a further ripping element 124 is inserted into tab 121 through open end 122. This element might be a piece of material, thread, paper, cellophane, or any other suitable product. This additional element 124 may be used to earmark or further strengthen and facilitate the use of rip tab 121. The element 124 may also carry a logo or be colored.

In FIGS. 14 through 17, a further embodiment of the present invention is disclosed. In this embodiment, only sealer bar 116 is shown. This sealer element is truly L-shaped.

In FIG. 14, the beginning of a new roll of center-folded wrap 100 is shown. Because it is a new roll that has not been presealed, leading edge 101, as well as base 103, is open. Accordingly, L-sealer bar 116 is brought against the sealer wrap to seal the leading edge 101. This being done, the L-sealer bar is lifted and as shown in FIG. 15 (as well as in the preceding examples), product 104 is placed between the sealer wrap sides 106 and 108 and the sealing frame is again brought down against the sealer wrap 100 with the product 104 contained therein. However, in FIG. 15, product 104 is not sealed into wrap 100 at open base 103 to any extent. An open edge remains. If the user wishes to make use of a product that is only partially wrapped, (as is disclosed in U.S. Pat. No. 4,697,401 to Kessler), then the product has been sealed with one open end as desired by Kessler without the need of a cutting mechanism. On the other hand, if it is desired to seal the product with an integral tear tab 121, then as shown in FIG. 16, the product 104 and its surrounding wrap must be readjusted. It must be turned so that edge 103 is now at a right angle to its original position. L-Sealer bar 116 is again brought down against the wrap surrounding product 104. Its leg portion 116*a* is now arranged parallel to edge 103 but importantly does not extend the full length of that edge. Instead, its extension is interrupted by leg portion 116*b* which lies at right angles to edge 103 and extends beyond that edge. It forms with sealed side 101 integral rip tab 121. L-sealer bar 116 is then lifted and as shown in FIG. 17 a product with an integral and open rip tab 121 has been formed ready for delivery or shrink wrapping. Meanwhile, a new product 104 is introduced into the remaining wrap 100 and the process described above is again repeated.

The present invention provides an expedited and superior means for wrapping an item with a rip tab. The step of punching openings in the wrap is eliminated since rip tab 120 acts as the main vent. An integral rip tab is provided without any slowing of the known method of packaging and, should the user wish a device sealed on all but one side, the invention discloses a means of attending to this without the necessity of a cutting means. The present invention contemplates various modifications to the sealing bars now used to result in products being sealed only partially, sealed in a circle or any other geometric form, and sealed with an integral rip tab. The drawings are not necessarily to scale and are meant as illustrative only. The present invention is claimed as follows.

We claim:

1. A sealing machine for sealing plastic wrap around products inserted between two sides of said plastic wrap, said sealing machine being comprised of:

a heat carrying bar means comprising two bars, each having two ends, one end of each bar extending in a first area to define at least a portion of the perimeter of a tear tab, the other bar ends defining the perimeter of a space in a second area, said one end of one of said bars extending at an angle away from and projecting from said second area to form a non-arcuate, abrupt angle with the remainder of said one bar, said one end of the other bar forming a linear continuation of the remainder of said other bar at said second area, said angle forming a tearing means, said bar means being arranged such that said tear tab, said first area, and said second area are integrally connected to each other, such that when said bar means is placed on said plastic wrap and around said product, said product lies in said space in said second area, said bar means being comprised of a single portion which both severs to seal the plastic lying thereunder so that the area of the plastic where said single portion was placed is melted together and severed from the remaining area of said plastic wrap, wherein upon tearing at said tab, said tab will rip away from said second area at the angle formed between said tab and said second area to enable one to access the products sealed in said second area.

2. The sealing machine of claim 1 wherein said bar mean is comprised of a first bar and a second bar, said first bar being straight in shape and said second bar being L shaped so that the foot of said L extends parallel to said first bar to form said first area.

3. The sealing machine of claim 2 wherein said first and second bars are mounted on a common base.

4. A sealing machine for sealing plastic wrap around products inserted between two sides of said plastic wrap, said sealing machine being comprised of a heat carrying first bar and a heat carrying second bar, said bars defining at least a portion of the outside perimeter of a tab in a first area and defining the perimeter of a space in a second area, said first area being integrally connected to said second area such that when said bars are placed on said plastic wrap and around said product, said product lies in said space in said second area, said tab extending from said second area, each of said bars acting to sever and melt the plastic lying thereunder to define the sealed edges of said second area and said tab, said first bar being comprised of three portions, a first portion extending in one direction; a second portion connected to said first portion and forming a right angle therewith; a third portion connected to said second portion and forming a right angle therewith; and wherein said second bar is L shaped, the foot of said L being located opposite and parallel to said third portion to form said first area.

5. The sealing machine of claim 1 further comprising at least one additional bar, said additional bar being connected on a common base with said bar means and being used to form at least one additional tab, said additional tab extending away from said second space.

6. The sealing machine of claim 1 further comprising an additional bar located parallel to one of said ends in at least said first area, said additional bar and said bar means being connected on a common base, said additional bar carrying less heat than said bar means and thereby acting only to melt the plastic thereunder but not to sever it.

7. A sealing machine for sealing plastic wrap around products inserted between two sides of said plastic wrap, said sealing machine being comprised of:

a heat carrying bar means comprising two bars, each having two ends, one end of each bar extending near one another in a first area to define at least a portion of the perimeter of a tab, the other bar ends defining the perimeter of a space in a second area, said one end of one of said bars extending at an angle away from and projecting from said second area to form a non-arcuate, abrupt angle with the remainder of said one bar, said one end of the other bar forming a linear continuation of the remainder of said other bar at said second area, said bar means being arranged such that said tab, said first area, and said second area are integrally connected to each other, said tab extending from said second area;

a second bar connected in common with said bar means and located near said ends in at least said tab area, said second bar having a serrated edge, such that when said bar means is placed on said plastic wrap and around said product, said product lies in said space in said second area, said bar means having a single portion which both severs and melts to seal the plastic lying thereunder so that the area of the plastic where said single portion was placed is melted together and severed from the remaining area of said plastic wrap, said second bar melting a plurality of spaced openings in said plastic thereby forming perforations in at least said tab, said perforations enabling said tab to be ripped along said perforations to access the product in said second area.

8. A sealing machine for sealing plastic wrap around products inserted between two sides of said plastic wrap, said sealing machine being comprised of:

a heat carrying bar having two ends and a main portion connected to said two ends, said two ends extending and projecting away from said main portion to define a first area, one of said ends being at an angle with respect to said main portion and forming a non-arcuate, abrupt angle therewith, the other of said ends forming a linear continuation of the main portion said angle forming a tearing means, said main portion defining the perimeter of a space in a second area, said second area and said first area being integrally connected to each other such that when said bar is placed on said plastic wrap and around said product inserted between said two sides of said plastic wrap, said product lies in said space and said first area defines a tab of plastic extending away and projecting at said angle from said second area to form said tearing means, said bar comprising a single means to sever and melt to seal the plastic lying thereunder, wherein upon tearing at said tab, said tab will rip away from said second area at said angle between said second area and said first area to enable one to access the product sealed in said second area.

9. The sealing machine of claim 1 wherein said ends of said bar extend at least to the edge of at least one of said sides of said plastic wrap so that said tab formed in said plastic wrap by said ends is open at an end.

10. The sealing machine of claim 1 wherein a piece extends from said bar means into said tab to create a slit in said tab.

11. The sealing machine of claim 8 wherein said ends of said bar extend at least to the edge of at least one of said sides of said plastic wrap so that said tab formed in said plastic wrap by said ends is open at an end.

* * * * *